US006861794B2

(12) United States Patent
Horne

(10) Patent No.: US 6,861,794 B2
(45) Date of Patent: Mar. 1, 2005

(54) COLOR DISPLAY DEVICE WITH COLOR FILTER AND PIGMENT

(75) Inventor: Remko Horne, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 437 days.

(21) Appl. No.: 09/741,656

(22) Filed: Dec. 19, 2000

(65) Prior Publication Data

US 2001/0024680 A1 Sep. 27, 2001

(30) Foreign Application Priority Data

Dec. 22, 1999 (EP) ..... 99204476

(51) Int. Cl.[7] ..... H01J 29/10

(52) U.S. Cl. ..... 313/466; 313/461; 313/463; 313/110; 313/112; 252/301.4 R

(58) Field of Search ..... 313/486, 463, 313/466, 461, 112, 110, 587; 252/301.4 R; 315/112; 430/27, 25, 23

(56) References Cited

U.S. PATENT DOCUMENTS 2,959,483 A 11/1960 Kaplan
4,217,520 A 8/1980 Sugarman ..... 313/472
4,392,077 A 7/1983 Libman ..... 313/474
5,936,339 A * 8/1999 Hayama et al. ..... 313/461
5,942,848 A * 8/1999 Van Doorn et al. ..... 313/461
5,952,776 A * 9/1999 Van Doorn et al. ..... 313/461
5,989,649 A * 11/1999 Itou et al. ..... 427/468
6,072,276 A * 6/2000 Okajima ..... 313/581
6,084,349 A * 7/2000 Ueoka et al. ..... 313/587
6,103,297 A * 8/2000 Aoki et al. ..... 427/72
6,140,758 A * 10/2000 Matsuda et al. ..... 313/466
6,517,741 B1 * 2/2003 Feldmann et al. .... 252/301.4 F

FOREIGN PATENT DOCUMENTS

DE 3104693 A1 8/1982 ..... H01J/9/227
WO WO9818148 4/1998 ..... H01J/9/227

* cited by examiner

*Primary Examiner*—David V. Bruce
*Assistant Examiner*—Elizabeth Keaney
(74) *Attorney, Agent, or Firm*—Aaron Waxler

(57) ABSTRACT

A display device (1) comprises a display screen (10) which comprises a blue color filter layer (24B) and a blue phosphor (25B). The blue phosphor is provided with or covered by blue pigments.

2 Claims, 2 Drawing Sheets

COLOR DISPLAY DEVICE WITH COLOR FILTER AND PIGMENT

FIELD OF THE INVENTION

The invention relates to a color display device comprising a substrate, said color display device having on the substrate a phosphor pattern of phosphor regions containing phosphors for emitting, in operation, red, blue and green light through a display window, with at least a blue color filter layer extending between the blue phosphor and the substrate.

Color display devices of the type mentioned in the opening paragraph are used inter alia in television receivers and computer monitors.

BACKGROUND OF THE INVENTION

A color display device of the type mentioned in the opening paragraph is known for instance from WO 98/18148. Said known color display device comprises a phosphor pattern which includes sub-patterns of phosphor regions luminescing red, green and blue light (hereinafter also referred to as 'red', 'green' and 'blue' phosphors). Colored layers (also referred to as color-filter layers) are provided under phosphor regions of corresponding color. The color filter layer absorbs incident light of different wavelengths than the light emitted by the relevant phosphor. This leads to a reduction of the diffuse reflection of incident light and to an improved contrast of the picture displayed. In addition the color filter layer may absorb a part of the emission radiated by the relevant phosphor, for instance emission peaks outside the wanted portion the visible spectrum, improving the color point of the relevant phosphor. The known color display device comprises at least a blue color filter layer.

There is ever greater emphasis on picture quality. The human eye is in particular very sensitive to inhomogeneities in the displayed image. The known device may suffer from such defects.

To reduce or overcome inhomogeneity in the displayed image is an object of the invention.

SUMMARY OF THE INVENTION

To this end a display device in accordance with the invention is characterized in that the blue phosphors comprises phosphor particles provided with blue pigment.

Providing blue pigment on the phosphor particles, whereas there is already a blue color filter layer provided may seem at first sight to be only counterproductive, since part of the optical absorption is transferred from the blue filter layer to the pigments, but since the pigments absorb not only light but also electrons the emission efficiency is reduced leading to an overall reduction in efficiency.

In reality, however, this detrimental effect is very small, and is more than compensated by a positive effect. Blue filter layers are, to be effective, relatively thick. This thickness has two detrimental effects. There is a risk of contamination, i.e. blue filter material being present under red or green phosphor layers, which reduces the image quality. Furthermore the height of the color filter layer introduces image errors known as the 60°-cross (for CMT's) and the North-South lines (for TVT's). The height of the color filter layers introduces a preferential direction for the flow of subsequent materials in particular phosphor materials. Such a preferential flow direction leads to differences in the thickness of the phosphor layers, and this becomes visible as lines of more than average intensity in the image.

Providing the phosphor particles with pigment enables part of the function of the color filter layer to be performed by the pigments in or on the phosphor particles. This in turn enables the use of blue color filter layers of lesser height, strongly reducing the above mentioned problems.

BRIEF DESCRIPTION OF THE DRAWING

These and other aspects of the invention will be apparent from and elucidated with reference to the embodiments described hereinafter.

In the drawings.

The figures are not drawn to scale. In general like reference numerals refer to like parts.

DETAILED DESCRIPTION OF THE PRIMARY EMBODIMENT

Figure 1:
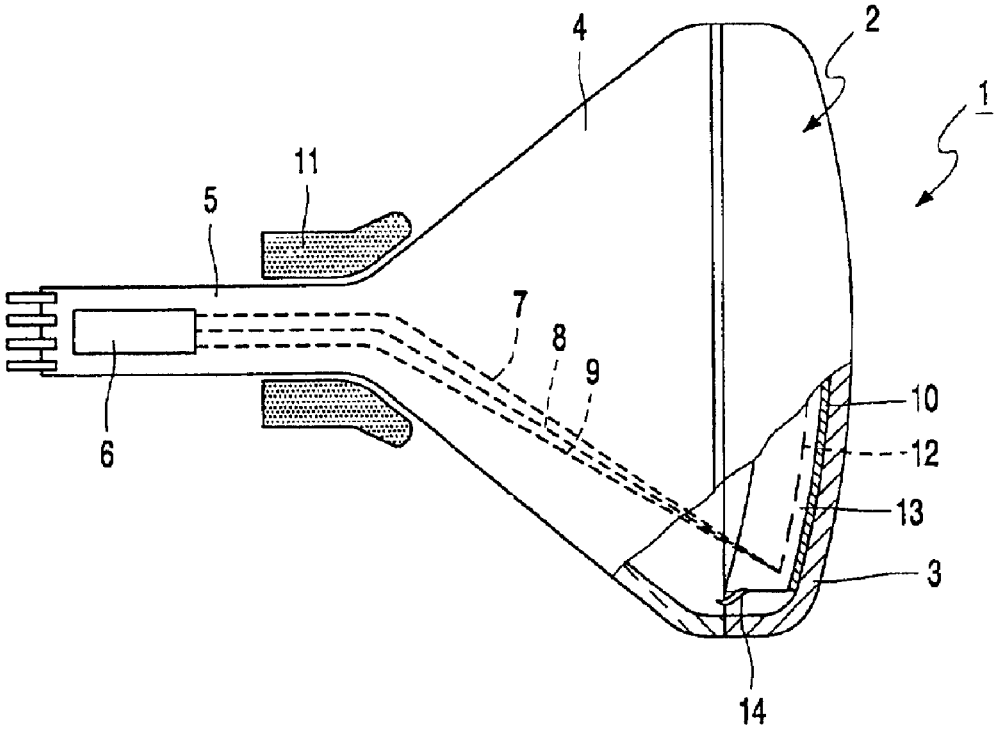
FIG. 1 is a sectional view of a display device.

A color display device (FIG. 1) comprises an evacuated envelope 2 including a display window 3, a cone portion 4 and a neck 5. In the neck 5 there is arranged an electron gun 6 for generating three electron beams 7, 8 and 9. A display screen 10 is provided on the inner surface of the display window. Said display screen 10 comprises a phosphor pattern of phosphor element luminescing in red, green and blue. On their way to the display screen 10, the electron beams 7, 8 and 9 are deflected across the display screen 10 by means of a deflection unit 11 and pass through a shadow mask 12 which is arranged in front of the display window 3 and which comprises a thin plate having apertures. The shadow mask is suspended in the display window by means of suspension means 14. The three electron beams 7, 8 and 9 pass the apertures 13 of the shadow mask at a small angle relative to each other and, consequently, each electron beam impinges on phosphor elements of only one color.

Figure 2:
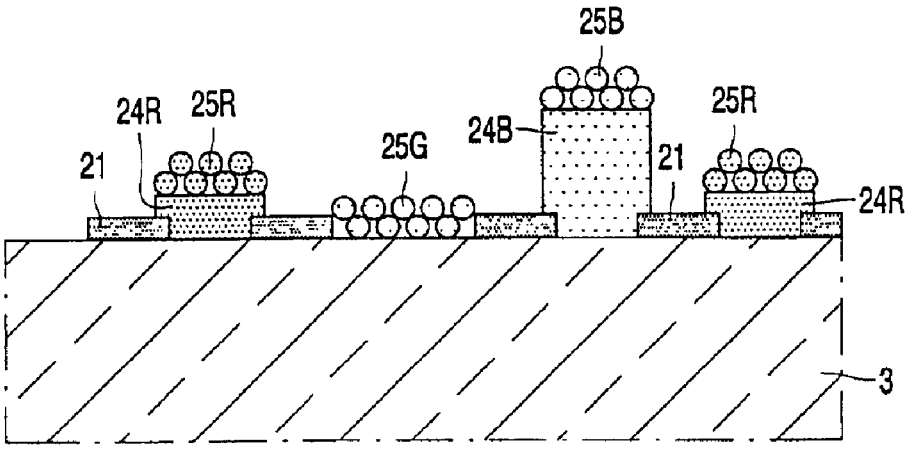
FIG. 2 is a sectional view of a display window for a display device in accordance with the invention.

FIG. 2 is a sectional view of a display window of a color display device in accordance with the invention. In this example a so-called black matrix is provided on the inner surface of the display window. A black matrix 21 is a pattern of black (non-reflective material) provided over the display window at those position where there are no phosphor regions. Such a black matrix reduces the reflection of incident light. Blue color filter layer 24B is provided under blue phosphor particles 25B. Red (25R) phosphor particles are also provided and in between the red phosphor particles 25R and the substrate 3 a red color filter layer. Green phosphor particles are provided directly on the substrate. The blue color filter layer is drawn in basically a block shape. In reality, however, a better approximation of the shape is a bell-shape, as indicated by the dotted lines. There is a risk, which risk increases with increase of height of the color filter layer, that some material of the blue color filter layer is present under the red or green phosphor particles. Such contamination reduces strongly the image quality because the color rendition is strongly influenced, for which effects the human eye is very sensitive. Furthermore the presence of the blue color filter layer, which is usually provided first, influences the rheology (flow patterns) of later provided liquids, including phosphor particles containing substances. As a result at certain parts of the display window a higher density of phosphor particles is provided than at other parts. This leads to the occurrence of the so-called 60°-cross and the North-South stripes. The image as seen on the display screen comprises a cross or a stripe of slightly higher intensity than the average intensity. Although the difference in intensity is small it is visible to the human eye and noticeably reduces the image quality.

Figure 3:
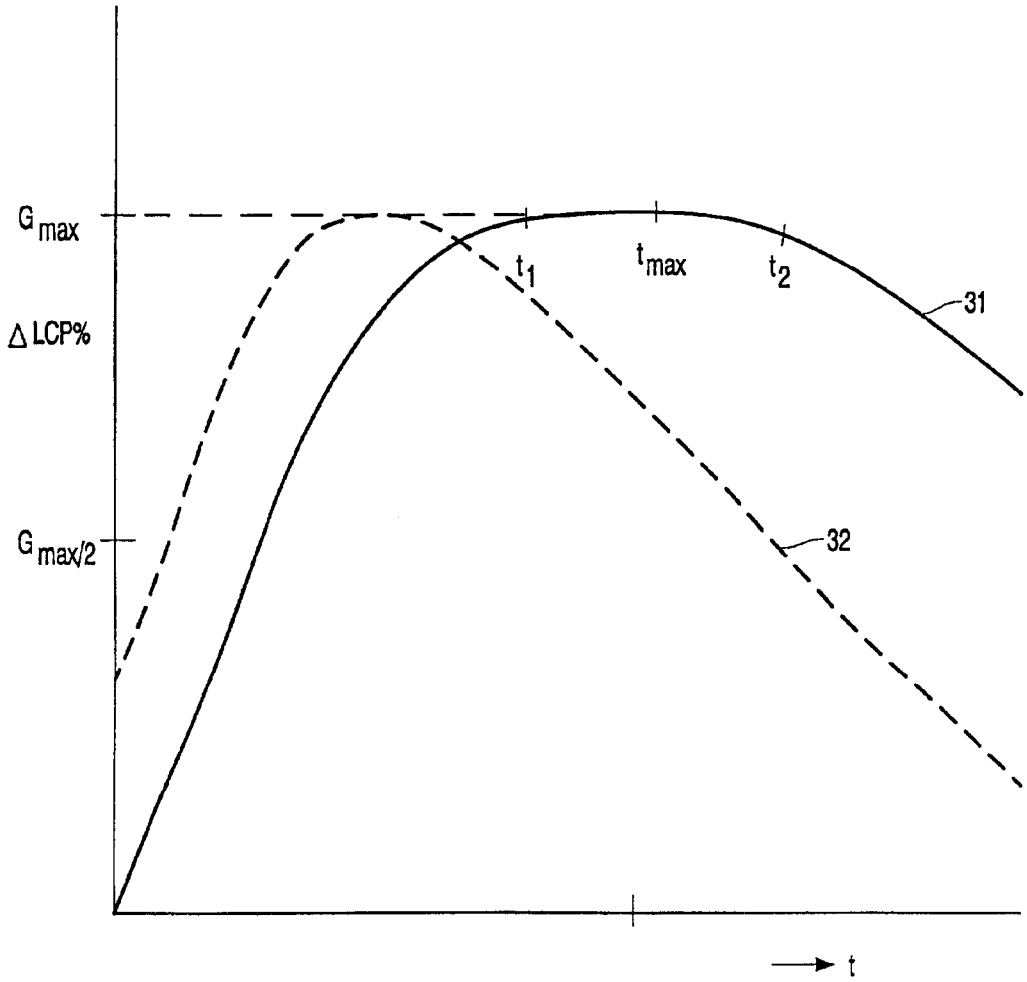
FIG. 3 illustrates the gain in contrast as a function of the thickness of the color filter layer.

FIG. 3 shows in a graphical form the influence of the height of the blue color filter layer on the contrast. The horizontal axis denotes the thickness of the blue color filter layer, while the vertical axis denotes the gain in contrast, expressed in percentage LCP (ΔLCP). The LCP is defined as the ratio of the luminance and the square root of the diffuse reflectivity). Using only a blue color filter layer the thickness is chosen approximately at the top part of the curve, i.e. where the gain in LCP is close to the optimal gain $G_{max}$ i.e. at thicknesses at which approximately the optimum gain is achieved, but not much more thicker than that in FIG. 3 approximately indicated between the thicknesses $t_1$ and $t_2$ and preferably close to $t_{max}$. For blue filter layers $t_{max}$ lies typically between 2 and 4 μm. The thickness t is chosen such that an optimum gain is achieved and such that variations in the thickness do not or hardly influence the result. Problems occur if the average thickness t lies on the steeply rising flank of the curve. The problems stem not so much from the fact that the gain is less than optimal (which is in fact the case), but from the fact that the color filter layer thickness t varies over the display screen by Δt. As a consequence the contrast gain and thus the contrast itself varies over the display screen. Furthermore, color differences are produced which are visible to the human eye. Problems may however, also arise if the thickness is more than roughly 2 μm. The above mentioned problems than start to occur. Line 31 illustrates schematically the situation for a color filter without using pigments. The maximum gain in LCP when using pigments only is roughly half the gain which may be obtained by using a color filter. Surprisingly the inventors have found that the gain in LCP when using a color filter and pigments is not as could be expected some average gain in between the gain for a color filter and pigments, as could be expected, but substantially the same as that when using only a color filter, be it that the maximum in gain is achieved at a substantially smaller thickness (roughly half) for the color filter. This is illustrated by line 32 in FIG. 3 which shows the gain as a function of thickness for pigmented phosphors. This enables, without substantially sacrificing gain in contrast to use substantially smaller thicknesses in color filter layers. These substantially smaller thicknesses reduce the problems such the occurrence of color differences and 60° cross and North-South lines.

In a display device in accordance with the invention the blue phosphor particles comprise or are covered with the blue pigment. As stated above a priori this seems to be only counterproductive. Part of the absorption function is transferred from the blue filter layer to the pigments, but since the pigments absorb not only light but also electrons the emission efficiency is reduced leading to an overall reduction in efficiency. This effect exists if account is taken only of the efficiency in terms of photons per electron. However, the transfer of absorption from the color filter to the pigment enables substantially smaller thicknesses of the blue color filter layer to be used, i.e. with a thickness corresponding to a point on the steeply rising curve. Variation in thickness exists but the effects of said variation in thickness of the filter layer are overcome or at least reduced strongly by the presence of pigments in or on the phosphor particles.

The reduction in thickness of the blue color filter layer reduces the above mentioned negative effects of a too thick filter layer namely contamination of color by the presence of blue color filter material under green and/or red phosphor and the existence of image defects such as the 60°-cross strongly. Overall a better image rendition is obtained. The invention is disclosed for a blue color filter layer. However, the invention can also be used for color filter layers of different colors, in the circumstances where the thickness of the color filter layer to obtain a maximum gain (when using only the color filter layer) is more than 2 μm.

What is claimed is:

1. Color display device comprising a substrate, said color display device having on the substrate a phosphor pattern of phosphor regions containing phosphors for emitting, in operation, red, blue and green light through a display window, with at least a blue color filter layer extending between the blue phosphor and the substrate, characterized in that the blue phosphors comprises phosphor particles provided with blue pigment.

2. Color display device as claimed in claim 1, characterised in that the thickness of the color filter layer is less than 2 μm.

* * * * *